US006748943B1

(12) United States Patent
Krimmer

(10) Patent No.: US 6,748,943 B1
(45) Date of Patent: Jun. 15, 2004

(54) FIREPLACE COVER

(76) Inventor: John P. Krimmer, 1426 N. Poplar Ave., Round Lake Beach, IL (US) 60073

( * ) Notice: Subject to any disclaimer, the term of this patent is extended or adjusted under 35 U.S.C. 154(b) by 0 days.

(21) Appl. No.: 10/427,304

(22) Filed: May 1, 2003

(51) Int. Cl.[7] ..... F24B 1/192

(52) U.S. Cl. ..... 126/547; 126/548; 160/DIG. 9; 160/DIG. 16

(58) Field of Search ..... 126/547, 548; 160/DIG. 9, DIG. 16

(56) References Cited

U.S. PATENT DOCUMENTS

| | | | | |
|---|---|---|---|---|
| 3,894,527 | A | * | 7/1975 | Ickes ..... 126/545 |
| 4,010,730 | A | | 3/1977 | Mitchell |
| 4,072,140 | A | | 2/1978 | Gallagher |
| 4,108,145 | A | | 8/1978 | Klomser |
| 4,160,442 | A | | 7/1979 | Fox |
| 4,183,348 | A | | 1/1980 | Smith |
| 4,236,499 | A | | 12/1980 | Simeone |
| 4,362,147 | A | | 12/1982 | Taglavore |
| 4,971,032 | A | | 11/1990 | Gardner |
| 5,052,371 | A | | 10/1991 | Robert |
| 5,301,655 | A | | 4/1994 | Licata |
| 6,073,625 | A | | 6/2000 | Ball |
| 6,539,936 | B2 | * | 4/2003 | Behn ..... 126/547 |

* cited by examiner

*Primary Examiner*—Alfred Basichas
(74) *Attorney, Agent, or Firm*—Meroni & Meroni, P.C.; Charles F. Meroni, Jr.; P. Derek Pressley

(57) ABSTRACT

A firebox cover for thermally sealing off a firebox while not in use comprising a flexible barrier member, a sealing member and a magnet member. The flexible insulating barrier member covers a firebox opening within a room preventing thermal energy within the room from exiting through the firebox opening and preventing thermal energy within the firebox from entering the room. The barrier member has a cellular structure with a thermally reflective front face and thermally reflective back face. The sealing member about the periphery of the barrier member provides a substantially air tight seal about edges of the barrier member when the sealing member is magnetically affixed to a metallic surface surrounding the firebox opening during use of the cover. The sealing member has a pocket for receiving the periphery of the barrier member, an expansion portion for maintaining contact between the sealing member and the surface surrounding the firebox opening during pressure changes across the barrier member, and a cavity for receiving the magnet member. The magnet that fits within the cavity of the sealing member magnetically affix the sealing member to the metallic surface surrounding the firebox opening.

9 Claims, 2 Drawing Sheets

FIREPLACE COVER

BACKGROUND OF THE INVENTION

1. Field of the Invention

The claimed invention generally relates to fireplaces. More specifically, the claimed invention relates to a cover for fireplaces having 2. Description of the Prior Art Fireplaces and wood burning stoves were once an essential part of a home functioning as the sole heat source for heating most homes. Today, most homes have gas or electric heating systems for heating homes, with fireplaces and wood burning stove being used to provide pleasing atmosphere in a home and are not relied upon as a heat source. With this change in the role of fireplaces in homes, fireplaces are not typically in use most of the time. Therefore, it is desirous to minimize heat loss associated with a fireplace while fireplaces are not in use. Many different types of covers and doors have been devised over the years for closing off the firebox of a fireplace while the fireplace is not in use. These previously issued United States Patents show several of these structures.

U.S. Pat. No. 4,010,730 issued to Mitchell discloses a shield adapted for use in conjunction with a fireplace having a front opening. The shield comprises a front panel, a pair of side panels disposed respectively at the ends of the front panel and extending generally transverse to the front panel, and the lower portion of the front panel being spaced from the opening of the fireplace a greater distance than the upper portion of the front panel when the shield is disposed adjacent the opening.

U.S. Pat. No. 4,072,140 issued to Gallagher discloses a fireplace heat loss shield having a fabric cover of woven fire resistant material that is emplaceable over the fireplace opening to inhibit loss of heated room air. The cover has pockets sewn along all four edges thereof, into which a rigid, rectangular frame is emplaced.

U.S. Pat. No. 4,108,145 issued to Klomser discloses an adjustable fireplace closure which when properly installed closes the front opening about a fireplace and virtually eliminates the drafting action of the fireplace.

U.S. Pat. No. 4,160,442 issued to Fox discloses a fireplace cover including a substantially rectangular flat sheet member of slightly greater width and height than the fireplace opening for overlapping and covering the same, a pair of one-piece foot members, each having a vertical leg mounted on the sheet member and fixed to a foot extending front-to-rear beneath and supporting the sheet member.

U.S. Pat. No. 5,301,655 issued to Licata discloses a fireplace draft eliminator for a fireplace having an opening in a front face about a hearth. The eliminator has a rear plate being of the same size and shape as the opening, so as to fit into the opening of the fireplace. An internal support frame is slightly smaller in size and shape as the rear plate and is attached to a front surface of the rear plate. A resilient gasket is mounted on the periphery of the internal support frame. A front plate is of generally the same shape as, but of greater marginal extent in height and width than the opening.

U.S. Pat. No. 6,073,625 issued to Ball discloses a fireplace opening closure for closing the front opening of a fireplace when the fireplace is not in use. The fireplace opening closure includes a generally rectangular board with front and back faces, top and bottom edges, and a pair of side edges extending between the top and bottom edges of the board.

These previously issued United States Patents disclose various types of fireplace closure structures, but fail to address the need for a fireplace cover that has reflective properties to reflect thermal energy within the room away from the fireplace, provides an air tight seal to prevent thermal energy from escaping about the edges of the cover, and is easily installed and stored when not in use. The claimed invention fulfills this need by providing a fireplace cover with reflective properties for reflecting thermal energy, an air tight sealing member for preventing thermal energy from passing around the cover, and a flexible magnetic member that allows the fireplace cover to be easily affixed to a fireplace when in use or rolled up and stored in a closet when not in use.

SUMMARY OF THE INVENTION

To fulfill the need for a fireplace cover with reflective properties for reflecting thermal energy having an air tight sealing member that is easily used and stored, the claimed invention provides a fireplace cover that generally comprises a flexible insulating barrier member, a sealing member about the barrier member, and a magnet member.

A primary object of the claimed invention is to provide a fireplace cover with improved insulation properties.

Another object of the claimed invention is to provide a fireplace cover with thermal energy reflective properties.

A further object of the claimed invention is to provide a fireplace cover that is easy to install.

An even further object of the claimed invention is to provide a fireplace cover that is easy to store while not in use.

To achieve the foregoing objectives, as well as others that will become apparent after reading this specification and viewing the appended drawings, the claimed invention provides a fireplace cover. The flexible insulating barrier member is sized and shaped to cover the opening of a firebox in a fireplace and is made of an insulation material having a reflective layer on each face of the material. The reflective layers reflect thermal energy within the room away from the fireplace so that the thermal energy is not lost by heated or cooled air escaping through the chimney of the fireplace.

The sealing member surrounds the barrier member to provide a seal about the periphery of the fireplace cover so that thermal energy can not pass by the edges of the barrier member. The sealing member has a pocket for receiving the periphery of the barrier member. Further, the sealing member preferably has at least one expansion rib that helps the fireplace cover to remain magnetically affixed to the face of the fireplace when pressure changes across the fireplace cover creates a force against the fireplace cover that may result in jarring the fireplace cover out of place.

The magnet member fits within a cavity of the sealing member that extends around the perimeter of the barrier member. The magnet member provides a magnetic force that affixes the fireplace cover against metallic surfaces surrounding the firebox opening of the fireplace.

When the fireplace cover is installed, thermal energy within the building is reflected away from the firebox opening and thermal energy attempting to enter the building through the chimney is reflected away from the interior of the building, thus reducing the overall thermal energy loss associated with having a fireplace within a building. Further, the sealing member of the fireplace cover prevents drafting air from entering or leaving the building through the chimney, thus greatly improving the thermal efficiency of the building.

BRIEF DESCRIPTION OF THE DRAWINGS

FIG. 1 shows a perspective view of the fireplace cover covering the opening of a fireplace.

FIG. 2 shows a perspective view of the backside of the fireplace cover.

FIG. 3 shows a cross sectional view of the fireplace cover affixed to a surface.

FIG. 4 shows a top view of the fireplace cover affixed to fireplace doors in front of a fireplace firebox.

DETAILED DESCRIPTION OF THE PREFERRED EMBODIMENT

Figure 1:
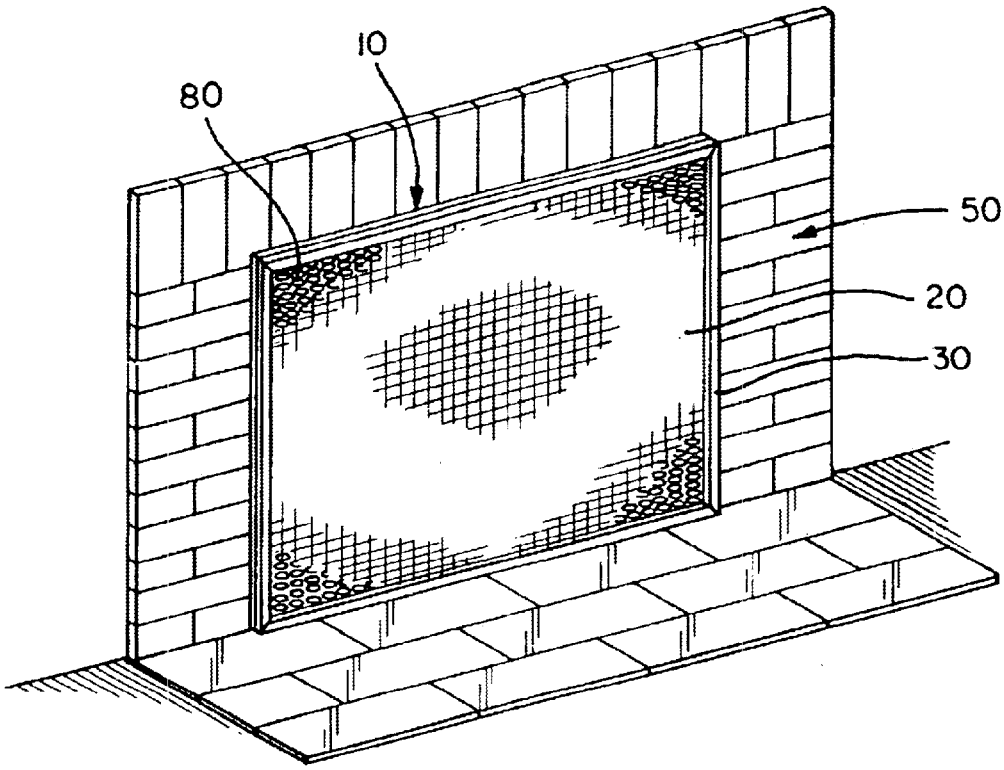
FIG. 1.
Figure 2:
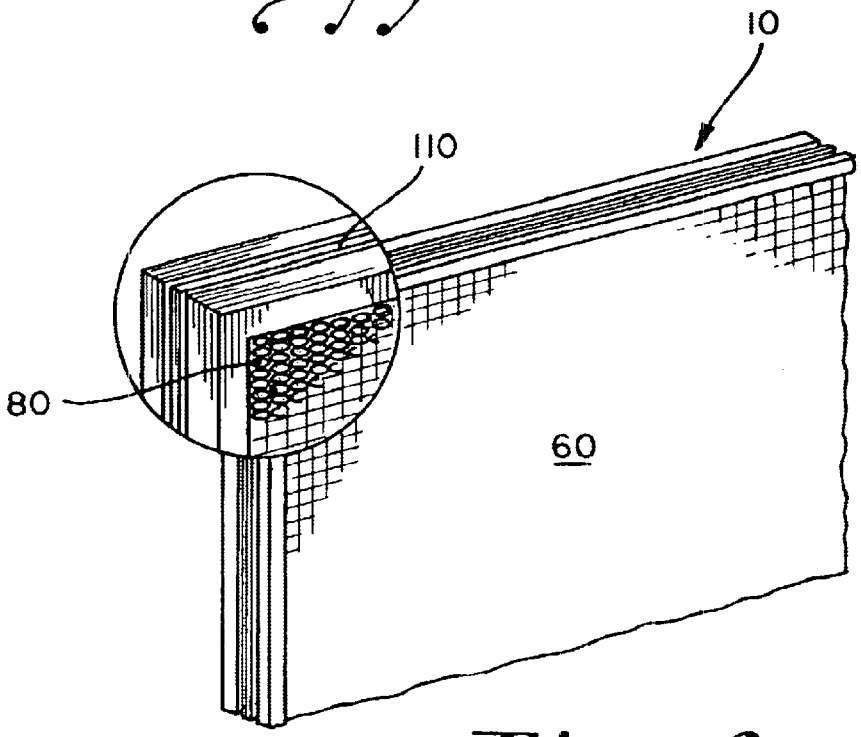
FIG. 2.

Turning now to the drawings, FIG. 1 shows a perspective view of the fireplace cover 10. The fireplace cover 10 generally comprises a flexible insulating barrier member 20, a sealing member 30, and a magnet member 40. The preferred embodiment of the claimed invention utilizes magnet members 40 located inside the sealing members 30 to affix the fireplace cover 10 to metallic surfaces 45 surrounding the firebox 47 of fireplace 50 and other similar type structures.

Figure 3:
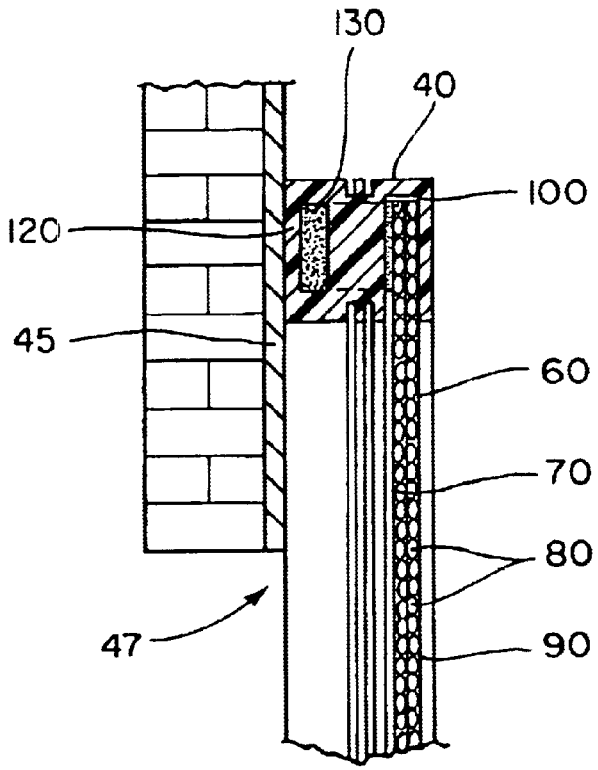
FIG. 3.

The flexible insulating barrier member 20 shown in FIGS. 1–4 is sized and shaped to cover the opening of a firebox 47 in a fireplace 50 or other similar type of structure such as a wood burning stove. Several standard sizes are contemplated in commercial embodiments of the invention. The barrier member 20 prevents thermal energy within the room from exiting through the chimney connected to the firebox 47 opening and also reflects thermal energy within the building back into the room having the fireplace 50. The barrier member 20 is preferably made of a reflective insulation material sold as REFLECTIX brand insulation. The barrier member 20 has an outer layer of reflective aluminum foil on the front face 60 and back face 70 that are bonded to a layer of polyethylene. These layers enclose two inner layers of insulating bubble pack 80 that are separate by a center layer of polyethylene 90 as shown in FIG. 3.

The sealing member 30 shown in FIGS. 1–4 surrounds the barrier member 20 to provide a seal about the periphery of the fireplace cover 10 so that thermal energy can not pass by the edges of the barrier member 20. The sealing member 30 is preferably made of a flexible plastic gasket type material commonly used to seal refrigerator doors. The sealing member 30 has a pocket 100 for receiving the periphery of the barrier member 20 that is sized slightly large than the 5/16" thickness of the barrier member 20 so that the barrier member 20 can be secured within the pocket 100 by adhesive or other conventional attachment means.

Figure 4:
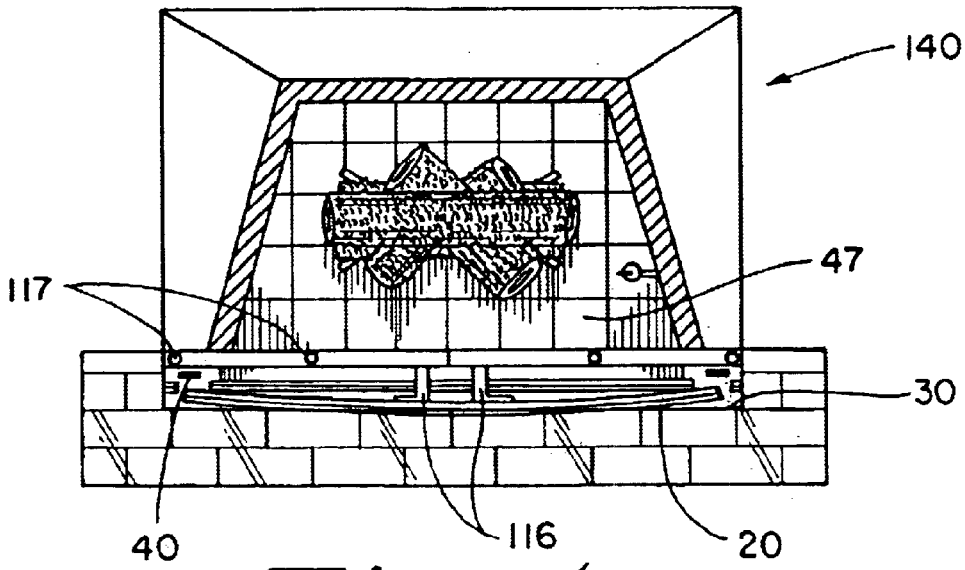
FIG. 4.

An expansion rib 110 assists in maintaining engagement of the sealing member 30 about the fireplace 50 when the fireplace cover 10 is deflected during use as shown in FIG. 4. Often, fireplaces have a set of glass doors with a metal frame 115 that provide an aesthetically pleasing appearance and partially seals off the fireplace 50 from the interior of the building. These types of structures typically have items such as handles 116 or hinges 117 that extend beyond the face of the doors 115 that present obstacles to placing a fireplace cover 10 over the doors 115 that more effectively prevent thermal energy from moving through the firebox 47 opening. The expansion rib 110 allows the fireplace cover 10 of the claimed invention to flex outwardly and around these obstacles, thus assisting the fireplace cover 10 in maintaining a substantially air tight seal about the firebox 47 opening.

The expansion rib 110 also assists in maintaining the engagement of sealing member 30 about the firebox 47 opening when a pressure change within the firebox 47 pulls upon or pushes against the fireplace cover 10. The expansion rib 110 partially compensates for these movements and allows the face 120 of the sealing member 30 to remain firmly affixed to a metallic surface 45 surrounding the firebox 47, such as metal fireplace doors 115 or metal trim.

The sealing member 30 has a cavity 130 for receiving the magnet member 40 as shown in FIG. 3. The magnet member 40 shown in FIG. 3 is sized and shaped to fit in the cavity 130 of the sealing member 30. The magnetic force of the magnet member 40 affixes the fireplace cover 10 against metallic surfaces 45 surrounding the firebox 47 opening.

The fireplace cover 10 of the claimed invention may be used year around to insulate a fireplace 50 or wood burning stove while not in use. Many homes have gas burning fireplaces 140 as shown in FIG. 4 that are used very few times throughout the year to provide a pleasurable atmosphere in a room. The fireplace cover 10 is ideally suited for this type of application. The fireplace cover 10 may also be sized and shaped to cover applications where the gas burning fireplace is of the steel insert type and has a ventilation system to circulate heated air from around the firebox 47 back into the building. The fireplace cover 10 will prevent drafts coming from the ventilation system while not in use to provide further insulation to the building. The fireplace 50 also draws heat from the interior of the building by convection through the structural portions of the fireplace 50. The fireplace cover 10 prevents this convective heat loss, thus providing a comprehensive thermal heat loss barrier.

The fireplace cover 10 is used by placing the cover 10 adjacent the firebox 47 opening of a dormant fireplace 50 and allowing the magnet members 40 inside the sealing members 30 to affix the fireplace cover 10 to metallic surfaces 45 surrounding the firebox 47 opening such as metal doors 115 as shown in FIG. 4. The fireplace cover 10 may then be easily adjusted to ensure that a proper seal is maintained between the face 120 of the sealing members 30 and the metallic surfaces 45 surrounding the firebox 47 opening. Having a sealing member 30 strip about all four sides of the barrier member 20 allows the fireplace cover 10 to form an airtight seal about all four sides of a firebox 47 opening.

Using magnetic force to affix the fireplace cover 10 to the fireplace 50 allows for easy installation and provides an effective insulating barrier that can be temporarily put into place without need for permanent hardware. The flexibility of the fireplace cover 10 allows the cover 10 to be rolled up and placed in a closet or under a bed while not in use.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A firebox cover for thermally sealing off a firebox while not in use, the cover comprising:

a flexible insulating barrier member sized and shaped to cover a firebox opening within a room preventing thermal energy within the room from exiting through the firebox opening and preventing thermal energy within the firebox from entering the room, the barrier member having a cellular structure with a thermally reflective front face and thermally reflective back face;

a sealing member about a periphery of the barrier member providing a substantially air tight seal about edges of the barrier member when the sealing member is magnetically affixed to a metallic surface surrounding the firebox opening during use of the cover, the sealing member having a pocket for receiving the periphery of the barrier member, an expansion portion for maintaining contact between the sealing member and the surface surrounding the firebox opening during pressure changes across the barrier member, and a cavity sized and shaped for receiving a magnetic member; and a magnet member sized and shaped to fit within the cavity of the sealing member having magnetic properties to magnetically affix the sealing member to the metallic surface surrounding the firebox opening.

2. The cover of claim 1 wherein the expansion portion comprises at least one expansion rib having an expansion channel on either side of the expansion rib.

3. The cover of claim 2 wherein the sealing member is a single piece extrusion of synthetic flexible material, the flexible material contributing to the expansive properties of the expansion portion.

4. The cover of claim 3 wherein the cellular structure comprises at least two layers of air bubble cells separated by a polyethylene layer.

5. The cover of claim 4 wherein the reflective front face comprises at least two layers of aluminum foil.

6. The cover of claim 5 wherein the reflective back face comprises at least two layers of aluminum foil.

7. A fireplace cover for thermally sealing off a fireplace while not in use in combination with a fireplace, the combination comprising:

a fireplace within a room having a rectangular opening with a pair of upright metallic side members adjacent the rectangular opening, and a pair of generally horizontal metallic top and bottom members adjacent the rectangular opening perpendicularly attached to the upright metallic side members;

a rectangular fireplace cover having a flexible insulating barrier member sized and shaped slightly larger than the rectangular opening of the fireplace preventing thermal energy within the room from exiting through the fireplace and preventing thermal energy within the fireplace from entering the room through the rectangular opening, the barrier member having a cellular structure with a thermally reflective front face and thermally reflective back face;

a sealing member about a periphery of the barrier member magnetically affixed to the upright metallic side members and the horizontal metallic top and bottom members, the sealing member having a pocket for receiving the periphery of the barrier member, an expansion portion for maintaining contact between the sealing member and the upright metallic side members and horizontal metallic top and bottom members when a pressure relationship between an interior portion of the fireplace and the room changes, and a cavity sized and shaped for receiving a magnetic member; and a magnet member sized and shaped to fit within the cavity of the sealing member having magnetic properties magnetically affixing the cover to the upright metallic side members and horizontal metallic top member.

8. The combination of claim 7 wherein the sealing member is a single piece extrusion of synthetic flexible material, the flexible material contributing to the expansive properties of the expansion portion.

9. The combination of claim 8 wherein the flexibility of the barrier member and sealing member material provide a cover for sealing the rectangular opening when the rectangular opening lies in more than one plane.

* * * * *